United States Patent [19]

Kocsi

[11] Patent Number: 4,584,586

[45] Date of Patent: Apr. 22, 1986

[54] MULTI-TURN LOOP RECEPTION ANTENNA

[76] Inventor: Louis Kocsi, 25 Palisade Ave., Garfield, N.J. 07026

[21] Appl. No.: 552,304

[22] Filed: Nov. 16, 1983

[51] Int. Cl.[4] ..... H01Q 11/12

[52] U.S. Cl. ..... 343/742

[58] Field of Search ..... 343/741–744, 343/866, 867

[56] References Cited

U.S. PATENT DOCUMENTS

| | | | |
|---|---|---|---|
| 2,537,191 | 1/1951 | Moore | 343/742 |
| 3,434,145 | 3/1969 | Wells | 343/742 |
| 3,573,832 | 4/1971 | Callaghan | 343/742 |
| 3,626,420 | 12/1971 | Kocsi | 343/742 |

FOREIGN PATENT DOCUMENTS

| | | | |
|---|---|---|---|
| 226861 | 8/1943 | Switzerland | 343/744 |

OTHER PUBLICATIONS

McCloud, "Switch Polarization Cubical Quad," *Radio Communication,* Jul. 1975, p. 533.

*Primary Examiner*—Eli Lieberman
*Assistant Examiner*—Michael C. Wimer
*Attorney, Agent, or Firm*—M. K. Silverman

[57] ABSTRACT

There is disclosed herein a multi-turn antenna which comprises an electrically conducting surface. This surface consists of an even plurality of symmetric pairs of hollow, substantially isosceles triangular loops. Each pair of loops is electrically connected to its adjacent pair. Each pair comprises an electromagnetic wave guide. Each symmetric pair is disposed parallel to its adjacent loop pair. All loop pairs are disposed perpendicularly to the direction of wave propagation, as defined by a primary broadcast source.

8 Claims, 10 Drawing Figures

MULTI-TURN LOOP RECEPTION ANTENNA

BACKGROUND OF THE INVENTION

The increased use of UHF in television broadcasting has created a need for an efficient antenna that will produce a high gain over a broad band of frequencies and will continue to do so even after a prolonged period of exposure to weather and, as well, over a wide range of elevational situations with respect to the broadcast site. Similarly, the needs for efficient reception in the VHF area have not been satisfactorily fulfilled in that, for example, many low-lying areas still encounter difficulties in the reception of VHF television signals notwithstanding their relatively close proximity to the broadcast site. Similarly, other topographical and environmental factors interfere with normal VHF reception. Accordingly, a need has long existed for an improved VHF and UHF reception antenna that can achieve a high gain over a broad band notwithstanding the elevation of placement of the antenna or other topographical factors.

The historically known style of stacking and coupling antenna elements together has restricted the number of elements which could be effectively coupled together in an array. This has been a limitation in the production of a high gain, broadband antenna in the UHF area in that UHF wave energy is readily lost, attenuated or otherwise altered at the antenna. This is particularly true at points in the antenna where the wave energy is transferred to or from feed lines through electrical contacts that may become corroded and even open during periods of extenuated use. Such changes in the conductive properties of electrical contacts after the antenna is put into operation causes the precisely established phase relationship between the coupled antenna elements to become atlered and, thereby, reduces the effectiveness of such an antenna.

An additional limitation in the prior art has been that VHF antennas have dictated one set of physical size requirements, while UHF antennas have stipulated a rather different size and design situation. Therefor, it has generally been not feasible to have in a single antenna the capability of receiving both VHF and UHF signals. In particular, in VHF reception, it is necessary to obtain an efficient induction of a tangential magnetic (or H-field) into the antenna support structure, e.g., the creation of currents in the antenna structure is necessary in order to capture the greatest possible amount of the H-field.

It is known that currents on a conducting surface are associated with an external tangential magnetic field that is maximum at the conducting surface. Such a magnetic field can generally be established and maintained more effectively by a loop element than by a stub or dipole element. However, while this has historically been recognized in the case with VHF reception, it is less established in the case of UHF reception in which the use of dipole elements is more conventional.

The prior art in this technology is represented by such patents as U.S. Pat. No. 3,434,145 to Wells and U.S. Pat. No. 3,823,403 to Walter. The pertinent area of classification is deemed to be U.S. Class 343, sub-classes 742 and 744, these sub-classes relating to high frequency type loop antennas.

SUMMARY OF THE INVENTION

The present invention relates to a multi-turn antenna which comprises a continuous electrically conducting surface. This continuous conducting surface is in the form of an even plurality of symmetric pairs of hollow, substantially scalene triangular loops, in which each pair of loops is electrically connected to its adjacent pair. Further, each pair of loops comprises an electromagnetic wave guide. Each pair of loops is disposed in parallel to its adjacent pair, all loops being disposed in a plane perpendicular to the direction of wave propagation by the broadcast source.

It is an object of the present invention to produce an antenna that will provide a high gain over a frequency band encompassing the totality of VHF and UHF frequencies.

It is another object of this invention to produce a directional antenna that will be operationally efficient even at low elevations with reference to the site of broadcast origination.

A further object is to furnish an antenna that will retain its original performance and efficiency even after prolonged exposure to weather.

Another object is to produce a bi-directional antenna array that will not require reactive loading.

A still further object is to produce a multi-turn loop antenna in which pairs of loop antenna elements are connected together at their high impedance points so that the energy of one loop pair is radiated to the successive loop pair.

A yet further object is to produce a multi-loop antenna that can simultaneously be used for purposes of television VHF and UHF, and radio FM reception.

A yet further object is to provide a multi-loop antenna having an improved mechanical design that will provide a maximum frontal area for H-field induction into a length and that will also be easy to assemble, have mechanically rugged features and offer minimal wind resistance.

The above and yet further objects and advantages of the invention will become apparent from the hereinafter set forth drawings, specification and claims.

DETAILED DESCRIPTION OF THE INVENTION

Figure 1:
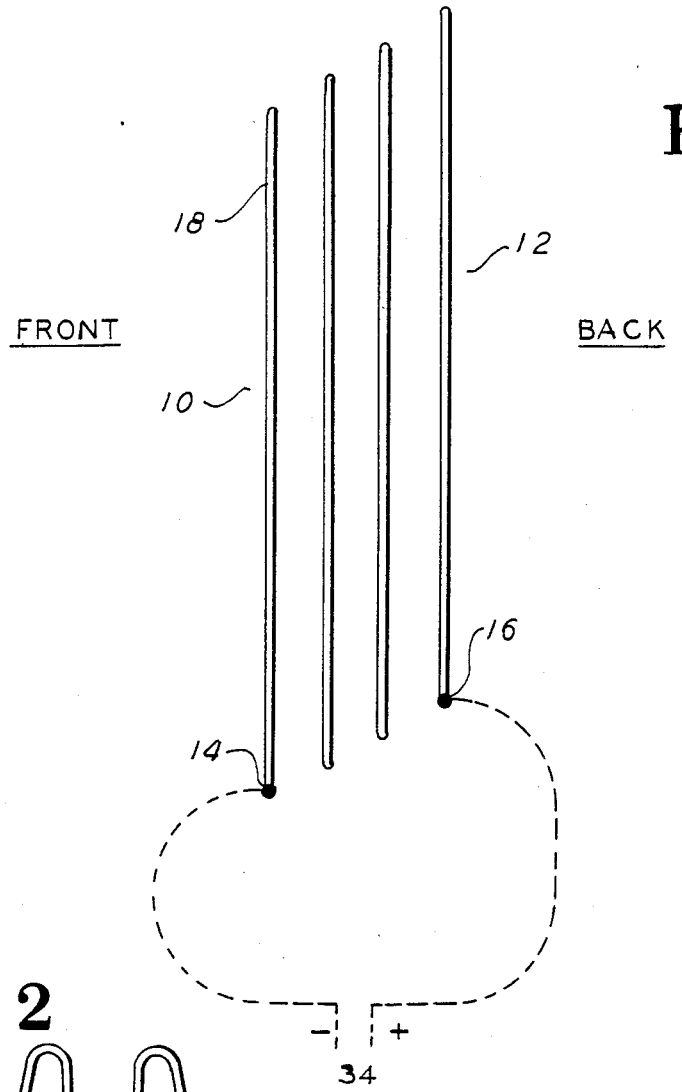
FIG. 1 is a side schematic view of a four-element embodiment of the present invention.

There is shown in FIG. 1 a cross-sectional side schematic view of a four-loop embodiment of the present antenna array. This view illustrates the array in normal operating position, namely, with the front end 10 facing the primary broadcast source and the back end 12 facing the secondary broadcast source. In this arrangement, the front end 10 of the antenna array is connected at a point 14 to the negative terminal of the conductor lead and thereby to the television receiver proper, while point 16 at the rear of the antenna array is connected to the positive lead of the antenna array. The schematic illustration of FIG. 1 corresponds to the perspective view of FIGS. 4 and 5. It is to be noted that the so-called front end of the antenna 10 is situated so as to face a primary broadcast source, e.g., a major urban area in which a number of VHF stations originate, while the back end 12 of the antenna array is disposed toward a secondary broadcast source, e.g., a site of which one or more UHF broadcasts originate.

Figure 2:
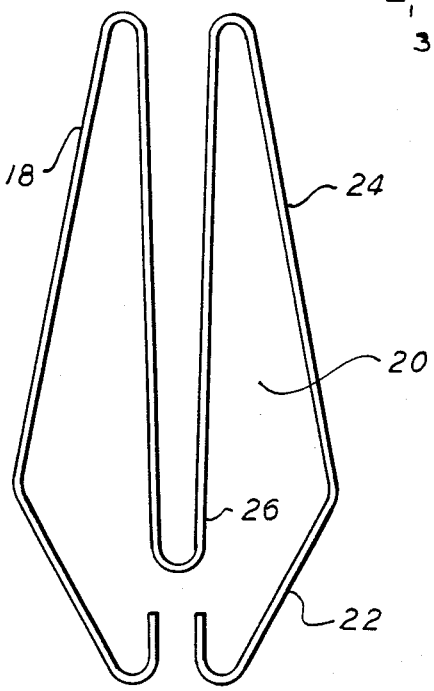
FIG. 2 is a front schematic view of a single loop element of the present antenna.
Figure 3:
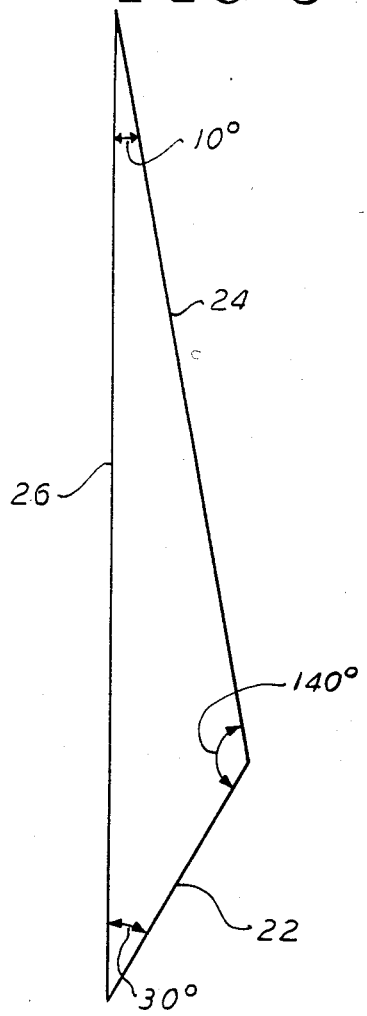
FIG. 3 is a theoretical representation of the geometric relationship between the legs of each side of the loop structure of FIG. 2.

Each element of the antenna array consists of a hollow metallic conducting surface having the general shape shown in FIG. 2. In one embodiment, 0.375 inch gauge aluminum tubing was found to be satisfactory. Such tubing has an interior diameter of about 0.325 inches. It was found that such tubing is appropriate for use as a wave guide of the electromagnetic waves which are captured by the disposition of the primary plane 20 (see FIG. 2) of the elements in a plane transverse to the direction of wave propagation. Each side of loop element consists generally of an scalene triangle having vertices of ten degrees, thirty degrees and 140 degrees. This is shown schematically in FIG. 3.

Figure 4:
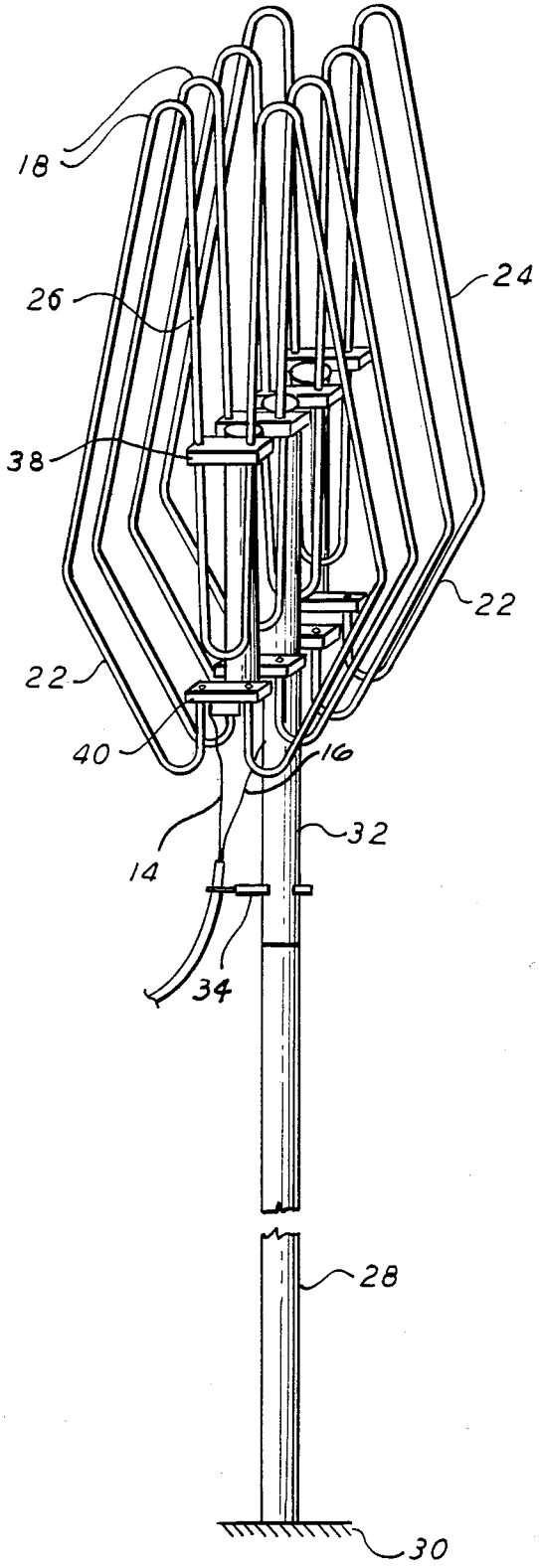
FIG. 4 is a front perspective view of the four-element embodiment of the present invention.
Figure 5:
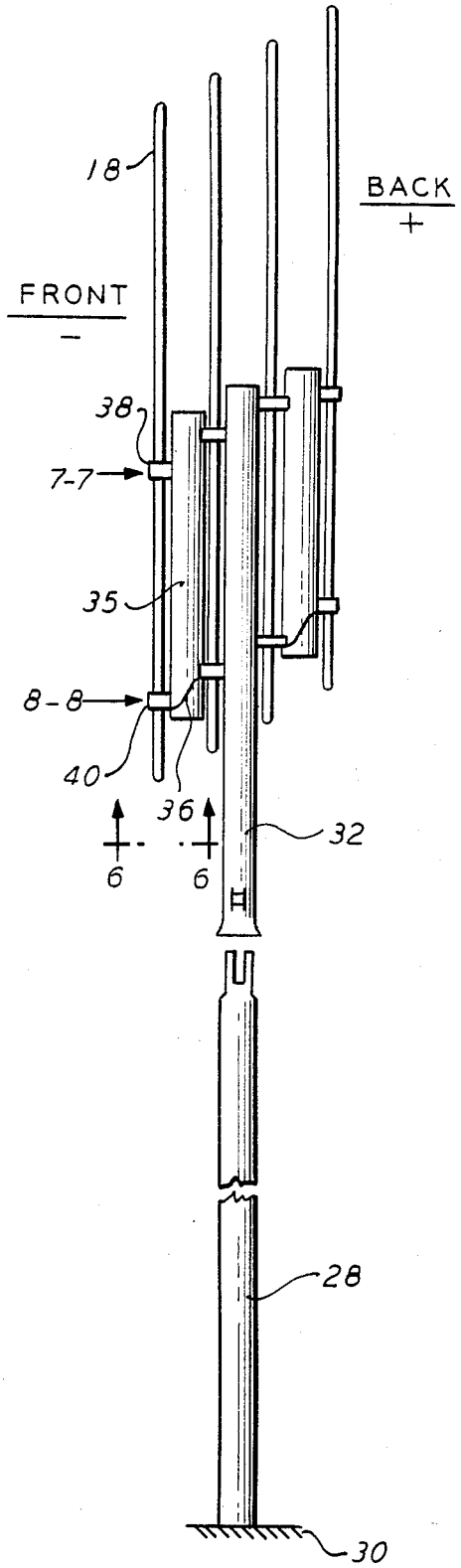
FIG. 5 is a side plan view of the embodiment of FIG. 4.

With further reference to FIGS. 1 and 5, it is noted that the distance between parallel loops 18 is about 3 inches while the entire array exhibits a cross-sectional width of about 9 inches. It is to be noted (see FIGS. 1, 4 and 5) that successive loops of the array are progressively elevated with respect to the preceding loop. This angle of elevation is approximately 30 degrees (see FIGS. 1 and 5).

With further reference to the geometry of the respective loops 18 of the antenna array, it is noted that the lengths of the legs are, in one embodiment, 12 inches, 25 inches and 35 inches; this translates into a ratio of about 1:2:3 for legs 22, 24 and 26 respectively. Leg 26 may be viewed as the entire hypotenuse connecting the legs 22 and 24. The distance from said hypotenuse 26 to the major vertex is about 8 inches. Based upon the above geometry, the cross-sectional area of a single one-half scalene triangular loop is about 140 square inches. Therefore, the cross-sectional area of an entire double loop (as shown in FIG. 2) is about 280 square inches. This area, when multiplied by the 9 inch width of the entire antenna array, yields a total volume of about 18 cubic feet within which the transverse H-fields are induced into the loops 18, thereby giving rise to the wave guide function therewithin.

A single loop comprises about 12 running feet of aluminum tubing; therefore, a four-loop antenna array comprises 48 running feet.

The positioning of an array upon the roof of a structure is particularly shown in FIGS. 4 and 5. In FIG. 4, a mast pole 28 is shown on top of a roof 30. Into the mast pole 28 is inserted a second pole 32 having a diameter slightly more than that of the hollow element 28 which preferably is formed of steel. Also shown in FIG. 4 is the connection between leads 14 and 16 which define the television conductor.

Figure 7:
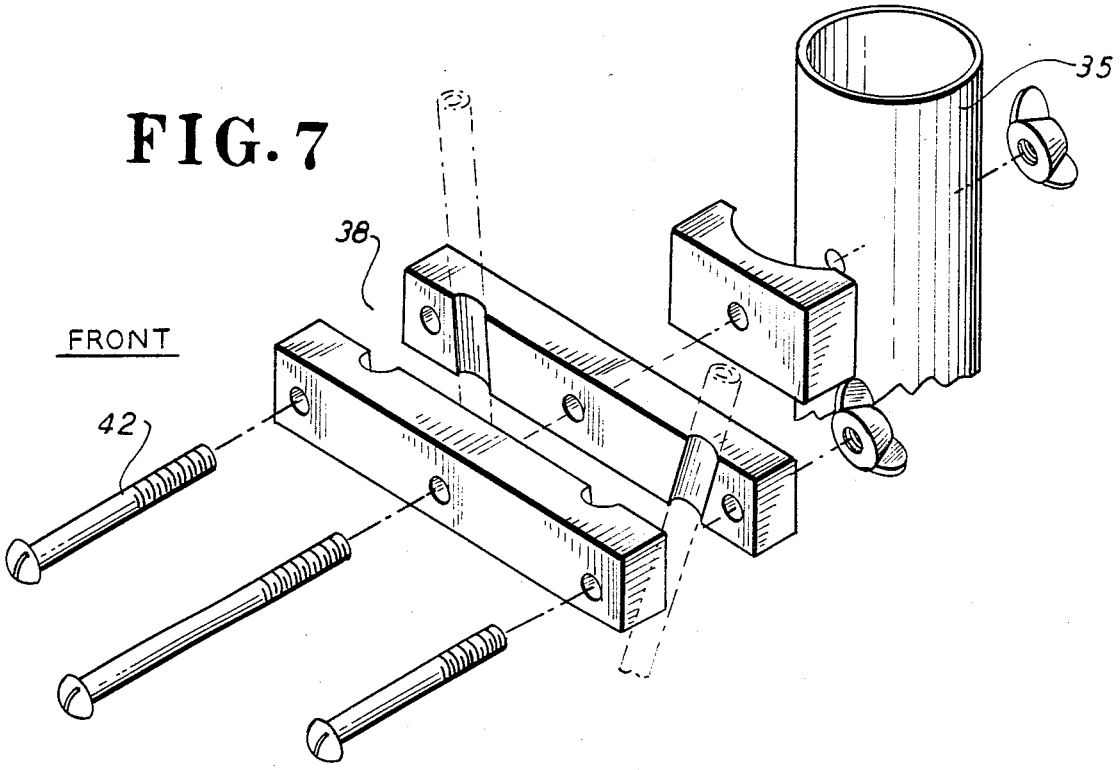
FIG. 7 is an exploded view illustrating the mounting components for the upper portion of the interior loop elements of the antenna array of FIGS. 4 and 5, taken along line 7—7 of FIG. 5.
Figure 8:
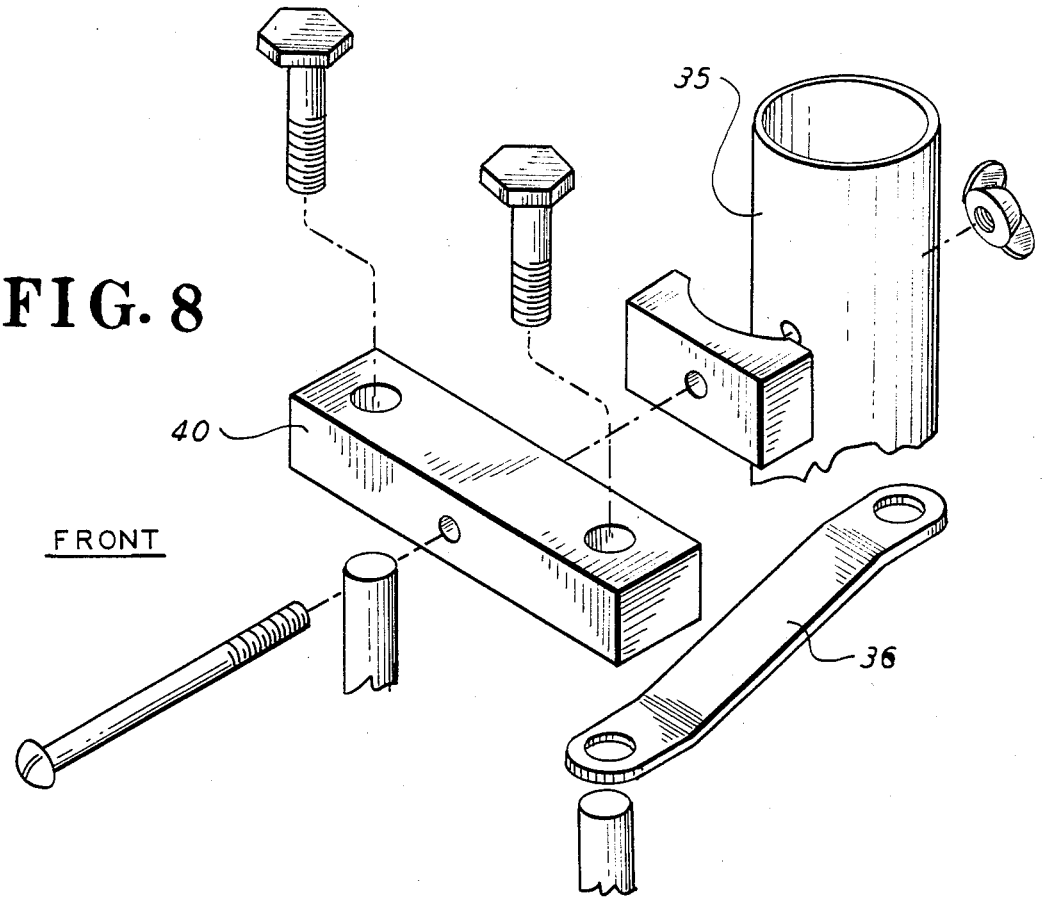
FIG. 8 is an exploded view illustrating the mounting components of the lower portion of the respective elements of the antenna array, taken along line 8—8 of FIG. 5.

FIGS. 7 and 8 are illustrations of the hardware used to secure the loops to separators 35. This hardware includes securement elements 36, 38, 40 and 42.

It has been found that the present antenna provides excellent reception for the entire VHF and UHF bandwidths, assuming disposition of the front and back of the antenna as above described with reference to the primary and seconday broadcast sources.

It is believed that the exceptional reception obtained by the present array is a result of the peculiar geometry of the antenna which facilitates the reception of the signals across a remarkably broad range of wavelengths. This is believed to occur because (as can be noted in FIG. 4) waves having particular wavelengths, or harmonics thereof, falling within any of the inter-linear or inter-spacial dimensions of the antenna array will be captured by the complex design of the array and, thereupon, will be induced into the hollow tubing of which the array is formed. Thereupon, each loop of the array will function as a wave guide in which the "captured" wave will be carried to the transmission line conductors 14 and 16 which are held by a mast snap-on insulator standoff 34. It has been found that a band separator [UHF (300 ohm), VHF (75 ohm)] is effective in carrying both VHF and UHF signals to the television conductor 14 and 16.

A further design feature of the present continuous open loop antenna is that its peculiar configuration maximizes the number of magnetic field flux lines which can pass through the effective receiving surfaces of the antenna. This is important in that it is believed that RF signals are magnetically drawn along patterns that conform to the magnetic field lines of the earth. Therefore, the configuration of the present array, which configuration itself bears a general resemblance to the magnetic flux lines existing about the earth, contributes to its effectiveness. That is, it is believed that the shape of the present array contains spherical curvatures which conform to the curvature of the magnosphere of the earth, along which it is believed electromagetic signals, at least to some extent, travel.

It is also to be appreciated that each loop of the inventor's antenna is a part of a larger continuous loop which thereby enhances the above-mentioned wave guide effect of the aluminum tubing and, also, provides certain capacitative effects within and between the loops. It has also been found that progressive elevation of each loop relative to its adjacent loop enhances the bandwith capability of the array as well as the quality of the reception of the array.

It is noted in FIG. 4 that the connection of the array from the television conductors 14 and 16 also connects the high impedance points of the antenna which, in this case, occur at the beginning and end points of the loop elements. The present antenna will match a conventional 300 ohm television conductor, thus facilitating ease of usage.

It is also to be noted that the present antenna does not require dielectric loading of the air cavities in the hollow antenna. This is an improvement over prior art hollow antennas which required a dielectric loading in order to obtain the desired reactance of the system. In the present case, it has been found that both the desired reactance, and the above-mentioned wave guide function, are achieved without any requirement to alter the 0.325 inch uniform interior diameter of the tubing, as above described.

Figure 9:
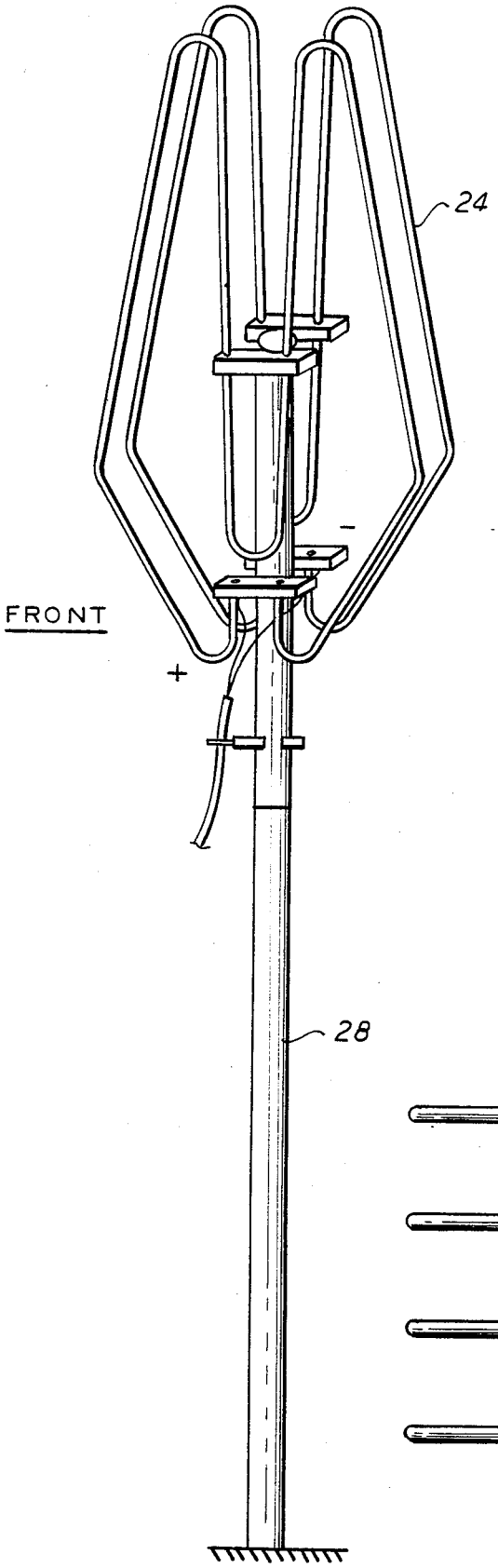
FIG. 9 is a perspective view of a two-loop embodiment of the present invention.
Figure 10:
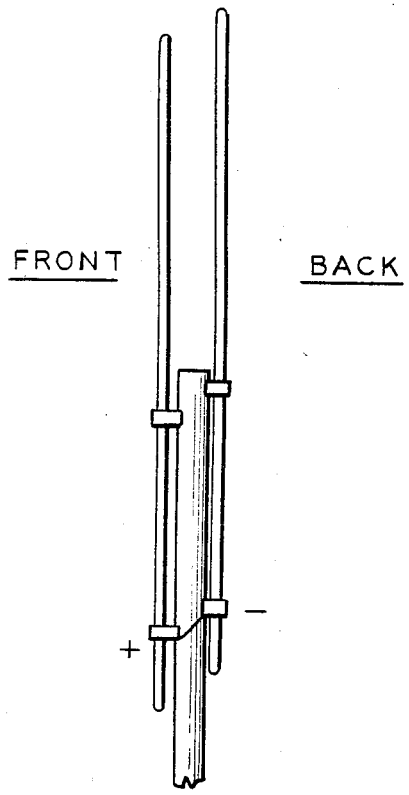
FIG. 10 is a side plan view of two-loop array shown in FIG. 9.
Figure 6:
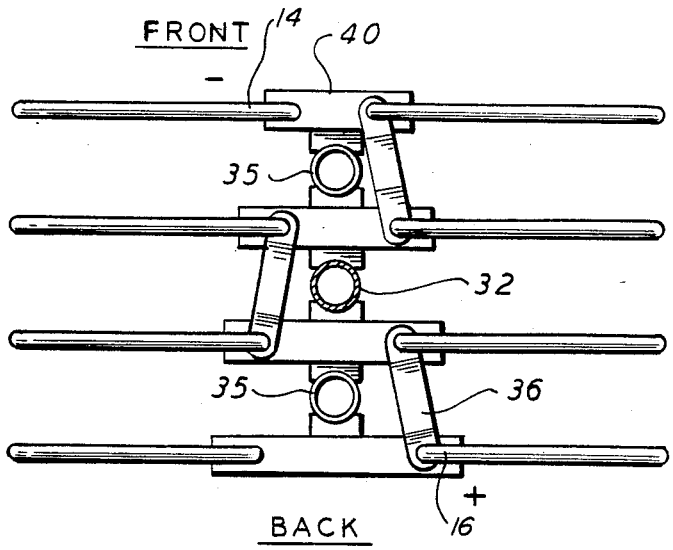
FIG. 6 is a bottom, cross-sectional perspective view of FIG. 5.

Shown in FIGS. 9 and 10 are side and front views of a two-loop version of the present antenna. It has been found that the use of a two-loop antenna is adequate in those areas that have generally good reception, whereas in poor reception areas, such as those below sea level and in poor elevational or topographical disposition to a broadcast site, the four-loop embodiment is preferred. The present antenna has been tested in northern New Jersey in a loction where seven VHF and four UHF channels were received with perfect reception. The four-loop antenna was placed in a below sea level area in Clifton, N.J., that suffered from chronically difficult reception conditions. In this test, the front of the antenna was disposed toward the primary broadcast area, namely, New York City, while the rear of the antenna was disposed toward the secondary (UHF) broadcast area, namely, Paterson, N.J.

The present mast-mounted loop antenna has been found to provide a proper gain and current flow for all known VHF and UHF channels regardless of topographical factors.

It is to be understood that while there has been shown and described the preferred embodiment of the present invention, the invention may be embodied otherwise than is herein specifically illustrated or described and that in such embodiment certain changes in the detail or construction, or in the form and arrangement of parts, may be made without departing from the underlying ideas or principles of this invention, within scope of the appended claims.

I claim:

1. A multi-turn antenna definable in terms of X, Y and Z coordinates comprising:

an electrically conducting surface having a longitudinal, vertical (Y), major axis, the surface comprising:

an even plurality of discreet open-ended vertical (Y) pairs of hollow, substantially scalene triangular loops symmetric about said vertical (Y) axis and disposed in an XY plane and, further, symmetric about said open ends of each loop, alternate ends of each loop electrically connected in a YZ plane to its Z-axis adjacent end, the hollow interior of each loop pair comprising a wave guide, each scalene loop pair disposed vertically and parallel to its adjacent loop pair, whereby an open circuit is maintained in each XY loop pair plane subject only to said YZ plane connections of alternate loop ends, this configuration permitting advantageous electrical current circulation through said double scalene loops, thereby obtaining an electromagnetic geometry having particular effectiveness in signal reception.

2. The antenna as recited in claim 1 in which said loops are formed of lengths of aluminum tubing.

3. The antenna as recited in claim 2 in which said tubing comprises 0.375 inch gage tubing.

4. The antenna as recited in claim 1 in which the angles of the vertices of each of said scalene triangle loop approximately equals 10, 30 and 140 degrees respectively.

5. The antenna as recited in claim 1 in which the legs of each of said scalene triangle loop have ratios of 1 to 2 to 3 as between the smallest, intermediate and largest respective legs thereof.

6. The antenna as recited in claim 2 in which the internal diameter of said tubing equals about 0.325 inches.

7. The antenna as recited in claim 5 in which each successive vertically symmetric pair of loops of the antenna array is elevated by about 30 degrees with reference to the preceding loop pair.

8. The antenna as recited in claim 6 in which each successive vertically symmetric loop pair of the antenna is elevated by about 30 degrees with reference to the preceding pair.

* * * * *